US005410826A

United States Patent [19]

Immel et al.

[11] Patent Number: 5,410,826

[45] Date of Patent: May 2, 1995

[54] ASSEMBLY AND METHOD FOR TOOTH TIP RETENTION

[75] Inventors: Darryl R. Immel, Waterford; Andrew P. Dretzka, Cudahy; Harvey J. Kallenberger, Wind Lake, all of Wis.

[73] Assignee: Harnischfeger Corporation, Milwaukee, Wis.

[21] Appl. No.: 24,393

[22] Filed: Mar. 1, 1993

[51] Int. Cl.[6] ..... E02F 09/28

[52] U.S. Cl. ..... 37/457; 37/455

[58] Field of Search ..... 37/398, 454, 455, 456, 37/457, 458, 452, 451, 450, 446, 453; 403/370, 320, 374, 409.1

[56] References Cited

U.S. PATENT DOCUMENTS

| | | | |
|---|---|---|---|
| 612,489 | 10/1898 | Dean | 403/370 |
| 1,767,713 | 6/1930 | Standfuss | 37/456 |
| 1,917,431 | 7/1933 | Clark | 37/455 |
| 2,280,662 | 4/1942 | Pawsat | 403/370 |
| 2,505,648 | 4/1950 | Pawsat | 403/370 X |
| 3,385,615 | 5/1968 | Hussey | 403/374 X |
| 3,410,010 | 11/1968 | Ratkowski | 37/454 |
| 3,496,658 | 2/1970 | Eyolfson | 37/455 |
| 3,528,691 | 9/1970 | Matich | 403/409.1 X |
| 3,664,044 | 5/1972 | Hahn | 37/456 |
| 3,974,621 | 8/1976 | Stang | 403/409.1 X |
| 4,120,105 | 10/1978 | Stepe . | |
| 4,136,469 | 1/1979 | Zepf . | |
| 4,238,896 | 12/1980 | Lanz et al. . | |
| 4,274,301 | 6/1981 | Katayama | 403/370 X |
| 4,338,736 | 7/1982 | Radigan | 37/458 |
| 4,357,765 | 11/1982 | Seykora | 37/455 |
| 4,413,432 | 11/1983 | Bierwith | 37/456 |
| 4,414,764 | 11/1983 | Johansson et al. . | |
| 4,516,340 | 5/1985 | Launder | 37/457 |
| 4,713,897 | 12/1987 | Hemphill | 37/454 |
| 4,716,667 | 1/1988 | Martin | 37/456 X |
| 4,782,607 | 11/1988 | Frisbee et al. . | |
| 4,939,145 | 6/1990 | Reeves, Jr. . | |
| 5,085,063 | 2/1992 | Van Dyke et al. | 403/374 X |
| 5,134,793 | 8/1992 | Bierwith | 37/458 |

*Primary Examiner*—Dennis L. Taylor
*Assistant Examiner*—Victor Batson
*Attorney, Agent, or Firm*—Jansson & Shupe, Ltd.

[57] ABSTRACT

A digging tooth assembly has first and second wedged members retaining a digging tooth tip on a tooth base. The improvement comprises a tension member, e.g., a bolt, coupled to the first member and engaging the second member. The bolt has an adjustable effective length so that the first member can be drawn into wedged engagement with the second member. Other aspects of the invention involve a method for assembling a digging tooth assembly having an apertured tooth tip on an apertured, supporting tooth base. The method includes the steps of inserting a first wedge-like member into the aperture, inserting a second wedge-like member into the aperture and drawing the first member upward into wedged engagement with the second member.

17 Claims, 7 Drawing Sheets

FIG. 14
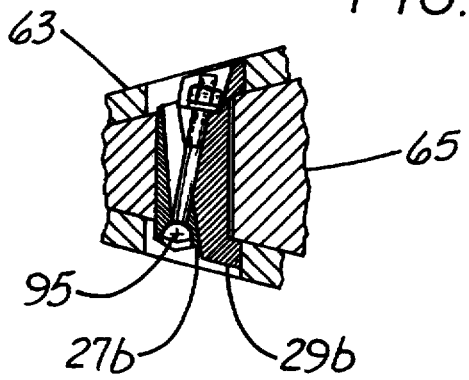
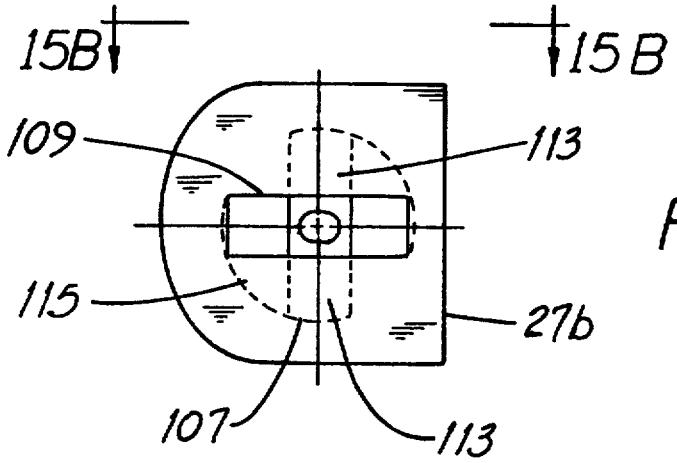
FIG. 15A
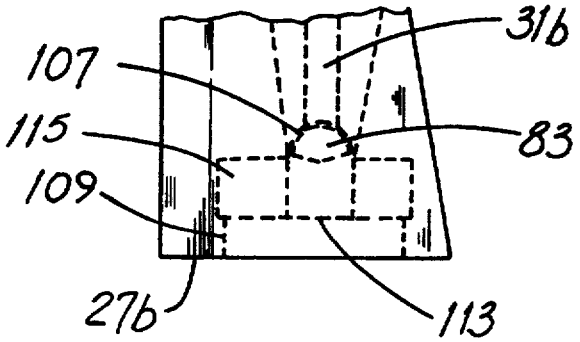
FIG. 15B

ASSEMBLY AND METHOD FOR TOOTH TIP RETENTION

FIELD OF THE INVENTION

This invention is related generally to digging, excavating and dragline mining equipment and, more particularly, to tooth assemblies used on the digging buckets of such equipment.

BACKGROUND OF THE INVENTION

Certain types of earth-moving and excavating machinery are equipped with digging buckets capable of holding anywhere from a fraction of a cubic yard to several cubic yards of material. One type of machine using a large digging bucket is called a walking dragline. Such draglines are often used in strip mining to remove "overburden" material covering, e.g., coal or ore, and to remove the product being mined. A large dragline may represent an investment of well over a million dollars; downtime is expensive, adds to the consumer cost of the product being mined and must be minimized.

Draglines are very large and include an enclosed machinery deck mounted on movable "legs" for machine transportability over a limited area. The machinery deck includes drive motors, cable reels, clutches and the like for manipulating a boom and boom-suspended bucket. The boom extends outward from the machinery deck by a distance of, for example, 300 feet or so. The digger bucket is attached to cables, one of which extends downward from the end of the boom to support the bucket weight and the other of which extends between the bucket and the machinery deck.

Digging is by lowering the bucket onto the material to be removed and dragging the bucket toward the machinery deck. As the bucket is drawn toward the machine, its digging teeth bite into the material as the bucket fills. After the bucket is filled, the boom is swung laterally and the bucket tipped for dumping the load. For a large dragline, the bucket capacity may be 80–90 cubic yards or even larger. And there are other types of machines, e.g., excavators, backhoes and the like, which use digger buckets mounted on articulated arms.

A large bucket may have several tooth assemblies, the individual components of which are typically quite large. For example, the tip of a digging tooth for a large bucket may have a length of 13 inches or so (as measured in the direction of digging), a width of about 12 inches and weigh about 160 pounds. And a large bucket itself may weight several thousand pounds.

More specifically, each hollow, sheath-like tip is fitted over and supported by a tooth "nose" or base. The tip (which is generally hollow to receive the base) has a pair of apertures, one each in the top and bottom tip plate. The base has a single vertical aperture. When the tip is fully seated on the base, the apertures are aligned and form a single vertical "top-to-bottom" aperture.

In conventional digging tooth assemblies, the tip is retained on the base by a wedge-shaped member sized so that when in place, a smaller aperture still remains. A wedge-shaped pin is driven (often with a sledge hammer) into this smaller aperture and retains the tip in place solely by friction. Because such digger buckets are subjected to severe use, often in hard mineral such as limestone, coal or rock, the bucket digging teeth wear and the above-described base/tip arrangement is configured in anticipation of periodic tip and/or wedge pin replacement.

The conventional wedge pin arrangement is attended by a number of disadvantages. One is that, over time, the wedge pins are knocked out or they can simply become loose and fall out. The tip then slips off of and falls from the base which may soon be broken off by continued digging. And repairing a broken base is a much more substantial task than replacing a worn tooth tip. Another disadvantage is that the wedge pin is usually hardened and repetitive hammering may cause the pin to splinter, sending shards of metal flying like shrapnel.

Yet another disadvantage is that the hardened wedge pin lacks significant resilience or ductility and this fact promotes pin loosening with slight wear. In other words, the parts are not self-adjusting to any significant degree.

Even if the wedge pin remains secure over the life of the tip, pin removal preparatory to tip replacement is a substantial task. Because such pins are driven from the top of the tooth downward, they must be removed by driving them upward using a hammer and drift pin. Access to the underside of the bucket is required to do this—and a bucket weighing several thousand pounds presents an imposing "positioning task." If the bucket teeth are merely lifted away from the ground (rather than totally inverting the bucket), an individual is required to work beneath the lifted bucket and this presents unnecessary risks.

Some wedge pin arrangements involve an aperture extending horizontally across the width of the tooth tip and tooth base. In theory, wedge pins should then be removable without gaining access to the bottom of the bucket. However, there is often too little space between tooth assemblies to permit either satisfactory wedge pin driving or later pin removal.

An improved apparatus and method for tooth tip retention which avoids drive pins, which eliminates a need for clear access to the bottom of the bucket and which retains the tooth tip by means other than merely friction would be an important advance in the art.

OBJECTS OF THE INVENTION

It is an object of this invention to provide an improved apparatus and method for tooth tip retention which overcomes some of the problems and shortcomings of the prior art.

Another object of this invention is to provide an improved apparatus and method for tooth tip retention which avoids driving wedge pins.

Another object of this invention is to provide an improved assembly and method for tooth tip retention which eliminates a need for clear access to the bottom of the bucket.

Yet another object of this invention is to provide an improved assembly and method for tooth tip retention which retains the tooth tip by means other than merely friction.

Another object of this invention is to provide an improved assembly and method for tooth tip retention which permits tooth tip removal from the top of the bucket.

Another object of this invention is to provide an improved assembly and method for tooth tip retention which utilizes readily-available tools.

Still another object of this invention is to provide an improved assembly which provides a degree of "selfadjustment." How these and other objects are accomplished will become apparent from the following descriptions and the drawing.

SUMMARY OF THE INVENTION

An aspect of the invention is an improvement in a digging tooth assembly having first and second wedged members retaining a digging tooth tip on a tooth base. The improvement comprises a tension member which is coupled to the first member and engages the second member. The tension member has an adjustable effective length whereby the first member is drawn into wedged engagement with the second member as the effective length of the tension member is changed.

In a highly preferred arrangement, the tension member includes a bolt coupled to the first member and extending through a plate in overlapping engagement with the second member. This effectively "links" the two members by the bolt so that when the bolt is tightened, the members are firmly wedged.

The improved assembly is arranged to be accessed solely through the open spatial region above the assembly. That is, the tension member includes an adjustment device (a bolt head, nut or the like) which is accessible through the region. The adjustment device is rotatable for changing the effective length of the tension member, i.e., tightening or loosening such tension member, thereby wedging and de-wedging the members.

The tooth base includes an aperture having a forward face, i.e., a face toward the tip end. The second wedge-like member includes an angled face having an upper portion and a lower portion and the upper portion is closer to the forward face than the lower portion. Such configuration permits drawing the first wedge-like member upward (as opposed to driving a pin downward) to wedge the members together.

In one highly preferred embodiment, the tension member includes a bolt and the bolt and the first member are in threaded engagement one to the other. The first member has an angled face in sliding engagement with the angled face of the second member as the members are drawn together. The angled faces are conformable grooved or serrated, thereby increasing the frictional surface areas of the faces. Even though friction comprises only one force component retaining the tip on the base, such serrated configuration maximizes such friction.

In another highly preferred embodiment, the bolt and the first member are coupled to one another by a pivot joint rather than being threaded together. The angled face of the second wedge-like member has a notch and the bolt is mounted for pivoting movement into and out of the notch for, respectively, installing and removing the tooth tip.

That plate through which the bolt extends and which is in overlapping engagement with the second member comprises a self-aligning washer having mating concave and convex surfaces. During installation and tightening, such washer compensates for changes in angularity between the bolt long axis and the angled face. Such compensation also occurs as the parts wear.

Another aspect of the invention involves a method for assembling a digging tooth assembly having (a) an open spatial region above the assembly and (b) a tooth base supporting a tooth tip. Such assembly is of the type wherein the tip and the base define an aperture. The method improvement comprises the steps of inserting a first wedge-like member through the spatial region into the aperture, inserting a second wedge-like member through the spatial region into the aperture and drawing the first member toward the spatial region to wedged engagement with the second member.

In one highly-preferred variant of the method, the wedge-like members are inserted into the aperture substantially simultaneously. The first wedge-like member is threaded to a bolt extending through a plate in overlapping engagement with the second member and the drawing step includes turning the bolt to decrease the distance between the first member and the plate.

In another highly-preferred variant of the method, the first wedge-like member and the second wedge-like member are inserted into the aperture in sequence. The first wedge-like member has a bolt coupled thereto by a pivot joint, the second member has a notch and the drawing step includes pivoting the bolt into the notch and tensioning the bolt by tightening the bolt nut.

Further details of the inventive assembly and method are set forth in the following detailed description and the drawing.

BRIEF DESCRIPTION OF THE DRAWING

FIG. 14 is a cross-section, side elevation view like that of FIG. 11 but with the adjustment device tightened and the installation tool removed.

FIG. 15A is a bottom plan view of a modification of the first wedging member of the second embodiment of the invention. Surfaces of portions are shown in dashed outline.

FIG. 15B is a side elevation view of the first wedging member of FIG. 15A taken along the viewing plane 15B—15B thereof. Parts are broken away and surfaces of portions are shown in dashed outline.

DETAILED DESCRIPTION OF PREFERRED EMBODIMENTS

Before describing the embodiments of the inventive digger tooth tip retention assembly 10, it will be helpful to appreciate how bucket digging teeth are used and how a tooth tip is conventionally retained on the tooth base. Following these descriptions, details of the new tip retention assembly 10 are provided.

Figure 1:
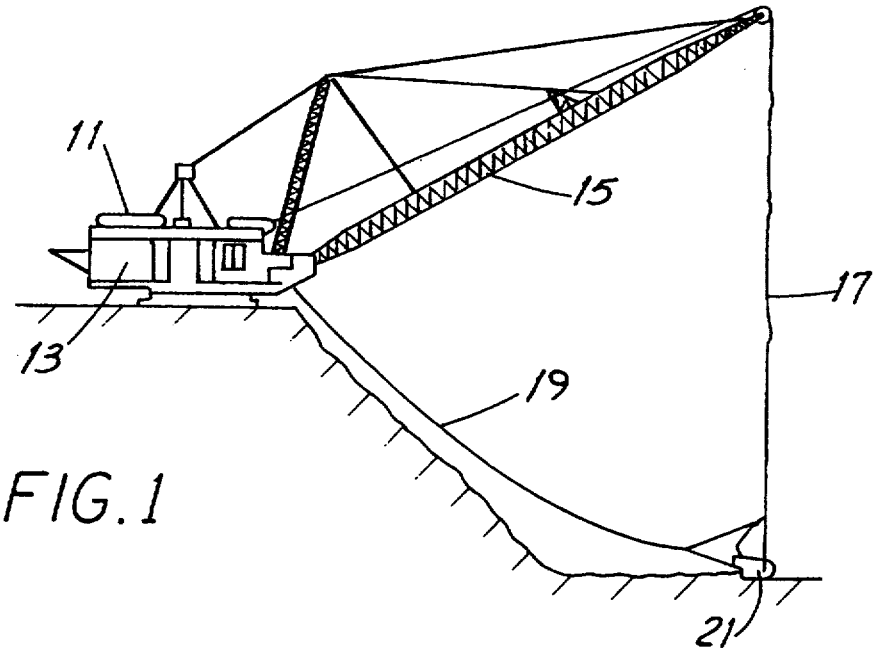
FIG. 1 is a side elevation view of a walking dragline in operation.
Figure 2:
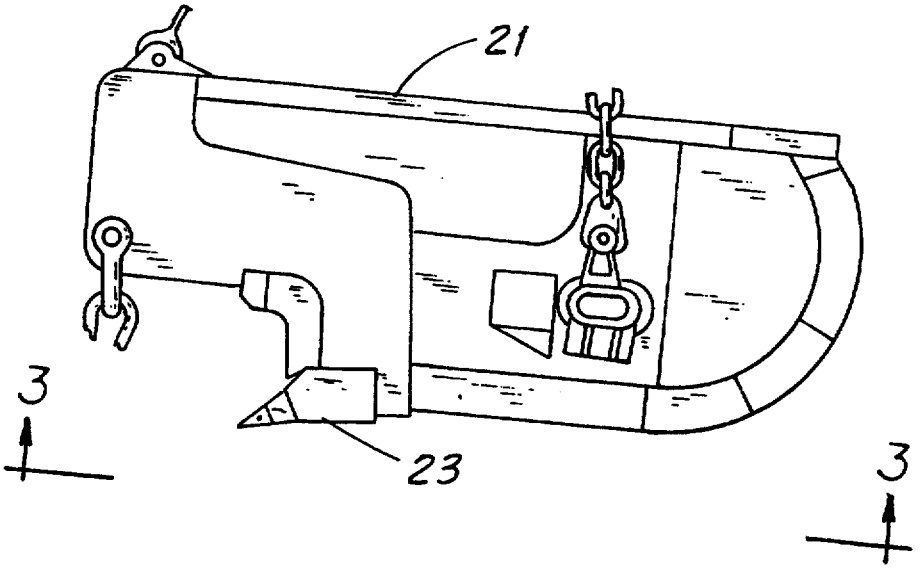
FIG. 2 is a side elevation view of a bucket used on the dragline of FIG. 1.
Figure 3:
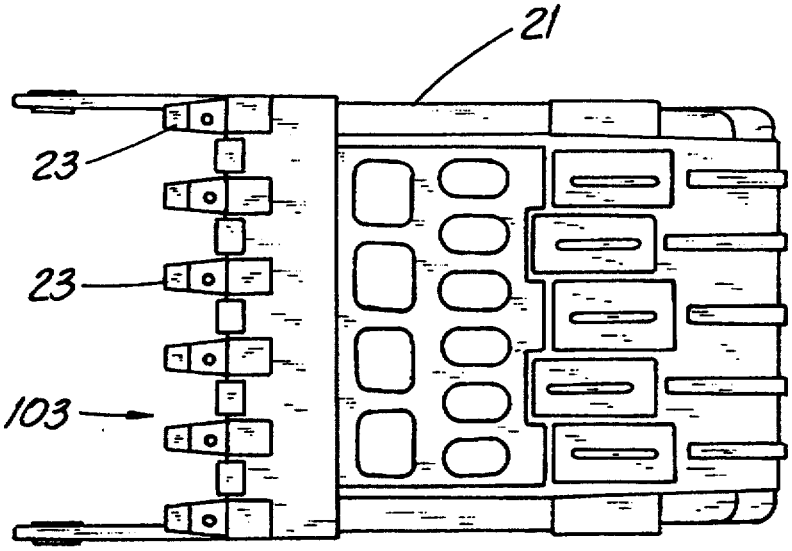
FIG. 3 is a bottom plan view of the bucket of FIG. 2 taken in the viewing plane 3—3 thereof.

Referring to FIGS. 1, 2 and 3, the illustrated walking dragline 11 includes a machinery deck 13, an extended boom 15 and cables 17, 19 hooked to the digging bucket 21. The cable 17 raises and lowers the bucket 21 and the cable 19 draws the bucket 21 toward the dragline 11 to load material into the bucket 21. The bucket teeth 23 bite into such material which fills the bucket 21 as it moves. When used with the exemplary dragline 11, such teeth 23 point toward the dragline 11 during digging. Of course, it should be clearly understood that buckets with replaceable tooth tips are used on a wide variety of digging machines; the illustrated dragline 11 is but one example of such a machine.

Figure 13:
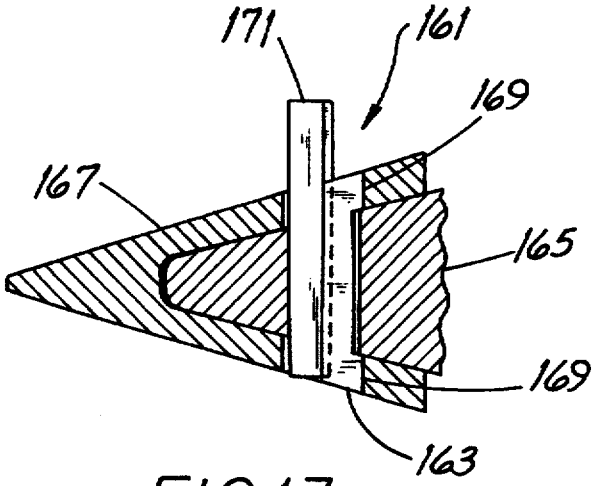
FIG. 13 PRIOR ART
FIG. 13 is a side elevation view of a prior art arrangement for retaining a tooth tip.
Figure 4:
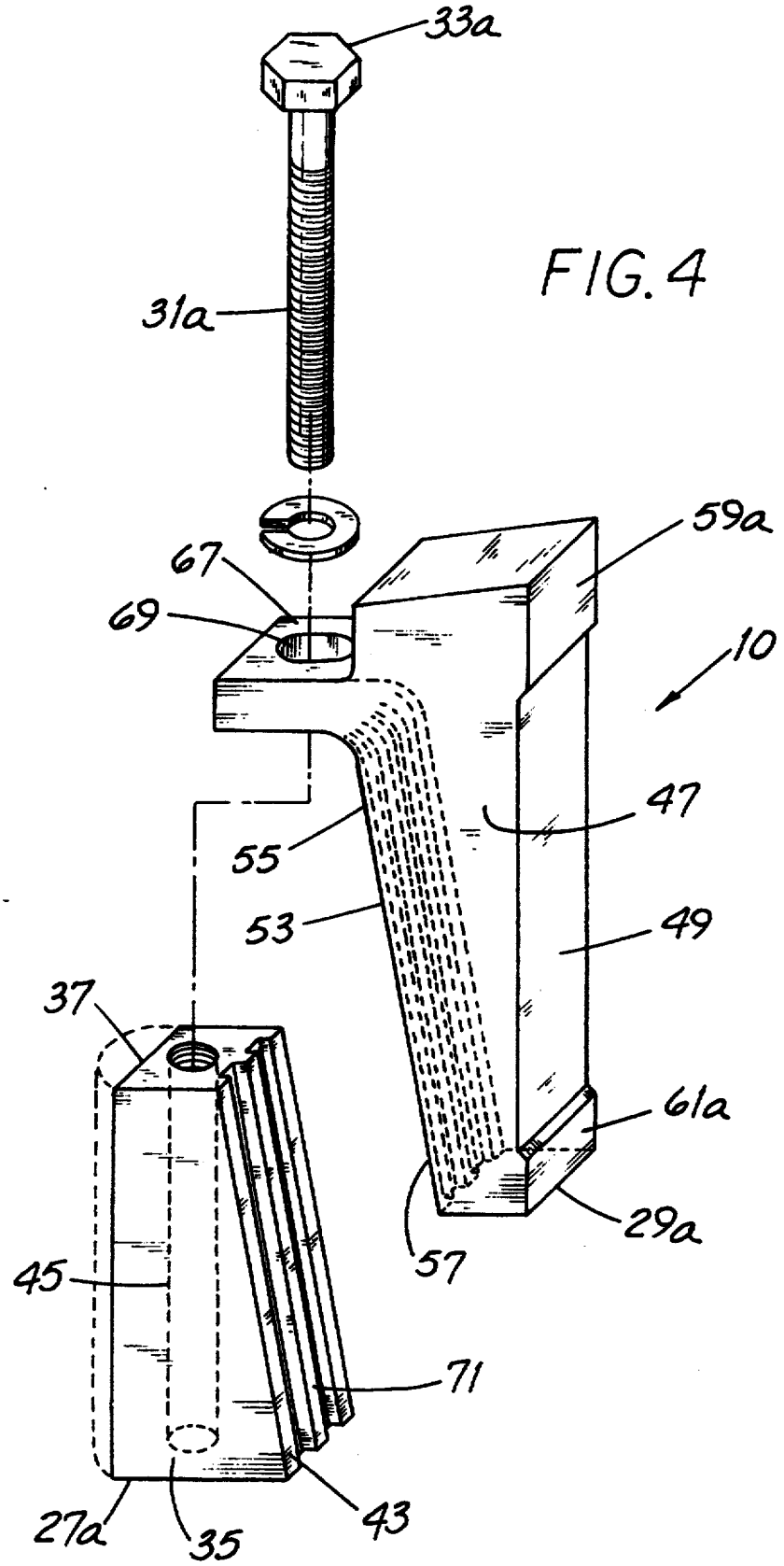
FIG. 4 is an exploded isometric view of a first embodiment of the invention. Hidden surfaces of parts are shown in dashed outline.

Referring to FIG. 13, a prior art retaining assembly 161 includes a wedge block 163 fitted into the aligned apertures of the tooth base 165 and the tooth tip 167. The block 163 is of substantially consistent thickness from top to bottom and has upper and lower protrusions 169 which .overlap the base 165, help retain the block 163 in vertical position and help urge the tip 167 tightly onto the base 165 as the wedge pin 171 is driven home. The pin 171 is driven top-down into the opening between the block 163 on one side and the base 165 on the other. Retained solely by friction, the pin 171 must be driven out from the bottom with a drift pin (not shown).

In this specification, terms such as "forward," "rear" and the like are used. Such terms are used with respect to the tip of a digging tooth in that "forward" means toward such tip, "rear" means away from such tip and so forth. Stated otherwise (and by way of example), a "forward" surface is closer to such tip than is a "rear" surface.

Referring now to FIGS. 4, 5, 6 and 7 a first highly preferred embodiment of the inventive assembly 10 will now be described. The assembly 10 includes first and second wedging members **27*a* and 29*a*, respectively. A tension member 31*a* such as a bolt is coupled to the first member 27*a*, engages the second member 29*a* and has an adjustment device 33*a*, e.g., the bolt head, rotatable for tensioning. The tension member 31*a* has an adjustable effective length whereby the first member 27*a* is drawn upward into wedge engagement with the second member 29*a* as the effective length of the tension member 31*a* is changed by rotating the adjustment device 33*a***.

More specifically, the first wedging member **27*a* has generally parallel side surfaces 35, a forward surface 37 generally coplanar with the front face 39 of the base aperture 41 and a rear surface 43 angled upward and toward the forward surface 37. The member 27*a* has a generally vertical hole 45 threaded to receive the bolt or similar tension member 31*a*. It is to be appreciated that depending upon the shape of the front face 39 of the aperture 41, surface 37 may be curved as shown in dashed outline in FIG. 4** or may be of some other shape.

The second wedging member **29*a* has generally parallel side surfaces 47, a rear surface 49 generally parallel to the rear face 51 of the base aperture 41 and a forward surface 53 angled upward and away from the rear surface 49. The forward surface 53 has an upper portion 55 which is closer to the forward surface 39 than is the lower portion 57 of such surface 53**.

The second wedging member **29*a* also has upper and lower protrusions 59*a* and 61*a*, respectively, which serve much the same function as the protrusions 169 described above with respect to FIG. 13. As will become apparent, the rear surface 43 of the first member 27*a* bears against and slides along the forward surface 53 of the second member 29*a* as the tension member 31*a* is tightened to retain the tooth tip 63 on the base 65 or is loosened to "de-wedge" the members 27*a*, 29*a* and replace the tip 63**.

"Linking" of the members **27*a*, 29*a* can be in any way that permits drawing the members 27*a*, 29*a* toward one another (or permits drawing one member toward the other) when the adjustment device 33*a* (e.g., the head of a bolt) is rotated to tension the member 31*a*. In one preferred arrangement, the second wedging member 29*a* has a forward protruding plate 67 with a slotted hole 69 through it for receiving the tension member 31*a*. Such slotted hole 69 extends in a forward/rear direction to permit slight movement of the tension member 31*a* along the hole 69 and with respect to the second wedging member 29*a* as the adjustment device 33*a*** is tightened or loosened.

Since friction (in addition to bolt tension) helps prevent the members **27*a*, 29*a* from sliding apart, the members 27*a*, 29*a* shown in FIGS. 4–7 each include conformably-shaped serrations 71 on the rear surface 43 and forward surface 53**, respectively. Such serrations increase the frictional surface area.

Referring next to FIGS. 8 through 12, a second highly preferred embodiment of the inventive assembly 10 will now be described. As with the first embodiment, the second embodiment has first and second wedging members **27*b* and 29*b*, respectively. A tension member 31*b* such as a bolt is coupled to the first member 27*b*, engages the second member 29*b* and has an adjustment device 33*b*, e.g., a nut threaded to the bolt, rotatable for tensioning. The tension member 31*b* has an adjustable effective length whereby the first member 27*b* is drawn upward into wedge engagement with the second member 29*b* (or is de-wedged from the second member 29*b*) as the effective length of the tension member 31*b* is changed by rotating the adjustment device 33*b***.

The first wedging member **27*b* has a curved forward surface 73 which bears against the forward face 39 of the base aperture 41. The surface 75 of the first wedging member 27*b* and the mating surface 85 of the second wedging member 29*b* are angled slightly upward and forward. Therefore, member 27*b* is urged against the forward face 39 and rear protrusions 59b, 61b of second member 29b are urged against the rear edges of the upper and lower openings in the tooth tip 63. The first member 27b also has an interior, generally U-shaped cavity 77 which opens via hole 79 into pivot pocket 81 having a curved top surface shaped somewhat like a longitudinally-cut half cylinder. As will become apparent from further explanation below, the pocket 81 receives the special pivot head 83 of a bolt-like tension member 31b**.

Figure 8:
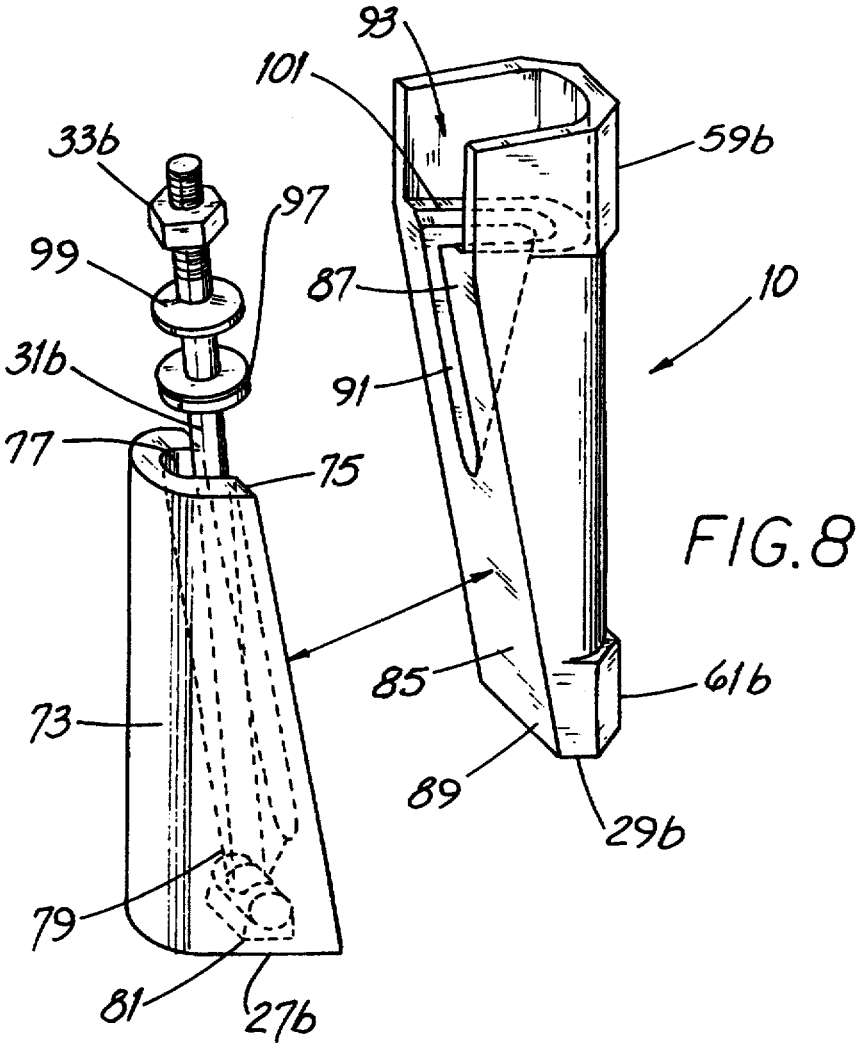
FIG. 8 is an isometric view of a second embodiment of the invention. Hidden surfaces of parts are shown in dashed outline.
Figure 12:
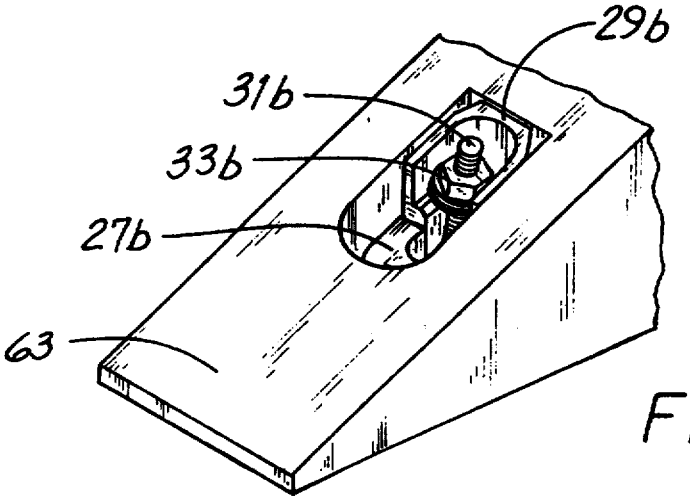
FIG. 12 is an isometric view of a tooth tip retained on its base by a second embodiment of the invention.
Figure 11:
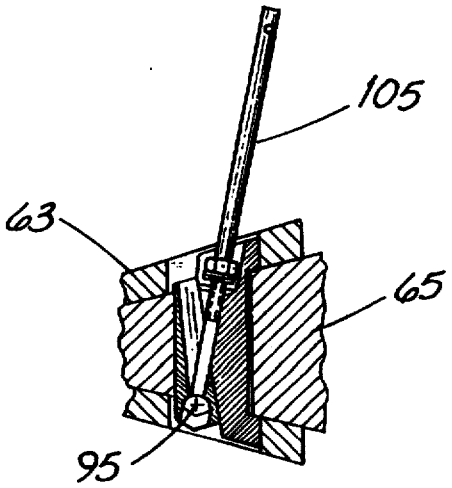
FIG. 11 is a side elevation view of the second embodiment of the invention in a final position in a tooth assembly prior to tightening the adjustment device. The invention is shown in conjunction with an installation tool. Parts are shown in cross-section and other parts are broken away.

The second member 29b has rear protrusions 59b, 61b which function much like the protrusions 169 described above. Of course, such protrusions 59b, 61b may also be curved or otherwise to match the shape of upper and lower openings of the tooth tip 63. The member 29b has a generally planar, angled forward surface 85, the upper portion 87 of which is closer to the forward face 39 of the aperture 41 than is the lower portion 89. A receiving notch 91 is formed in the surface 85 and terminates in a U-shaped pocket 93. As shown in FIGS. 8 and 11, the notch 91 is progressively deeper as viewed from the notch bottom upward toward the pocket 93 and has an angle and depth selected to receive the tension member 31b which can be pivoted into or out of the notch 91 as described below.

Figure 9:
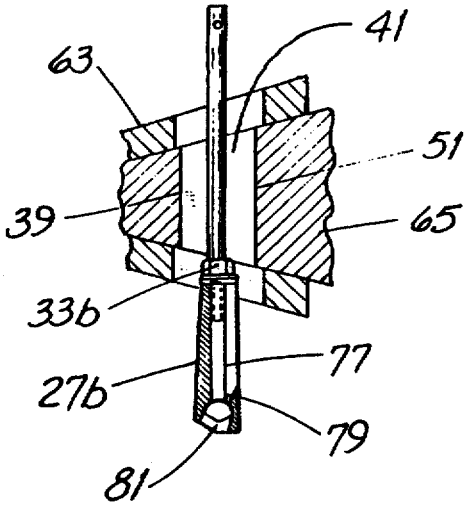
FIG. 9 is a side elevation view of the first wedging member of the second embodiment of the invention in an initial insertion position in a tooth assembly and shown in conjunction with an installation tool. Parts are shown in cross-section and other parts are broken away.
Figure 10:
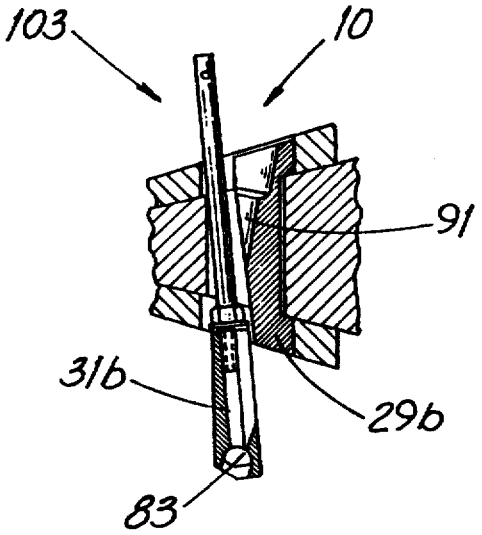
FIG. 10 is a side elevation view of the second embodiment of the invention with the second wedging member installed and the first wedging member in an intermediate position in a tooth assembly. The first wedging member is shown in conjunction with an installation tool. Parts are shown in cross-section and other parts are broken away.

Referring to FIGS. 11 and 14, the tension member 31b comprises a special bolt having a pivot head 83 which is half-cylindrical and generally conformably shaped to fit into and pivot within the pivot pocket 81 to form a pivot joint. As seen in FIGS. 9–11, the long axis 95 of the half cylinder pivot head 83 extends into and out of the drawing so that the tension member 31b readily tips forward or rearward (as referred to the tip 63; left or right in the plane of the drawing) but is substantially restrained from lateral tipping (as referred to the tip 63; into or out of the plane of the drawing).

The bolt extends upward first through a plate-like, two-piece spherical self-aligning washer 97 and then through a disc spring 99. A prevailing-torque nut device 33b is threaded onto the upper end of the bolt and the washer 97, the spring 99 and the device 33b are commonly available hardware. A prevailing torque nut device is a nut with, for example, deformed threads or a nylon insert that prevents the device from being loose on a bolt even though the nut and bolt are not tightened to tension. The spring 99 helps retain tension and the washer 97 maintains effective force transfer between the tension member 31b and the floor 101 of the pocket 93 as the angle of the bolt long axis changes slightly with respect to the angled surface 85 and the pocket 93 as the device 33b is tightened or loosened.

Referring again to FIGS. 3–7 and 8–12, a method for assembling a digging tooth assembly will now be set forth. One of the significant advantages of the new retention assembly 10 is that, in either embodiment, such assembly 10 can be inserted through the open spatial region 103 above the assembly 10. The improved method comprises the steps of inserting the first wedge-like member 27a or 27b through the spatial region 103 into the aperture 41, inserting the second wedge-like member 29a or 29b through the spatial region 103 into the aperture 41 and drawing the first member 27a, 27b toward the spatial region 103 and into wedged engagement with the second member 29a, 29b.

Figure 5:
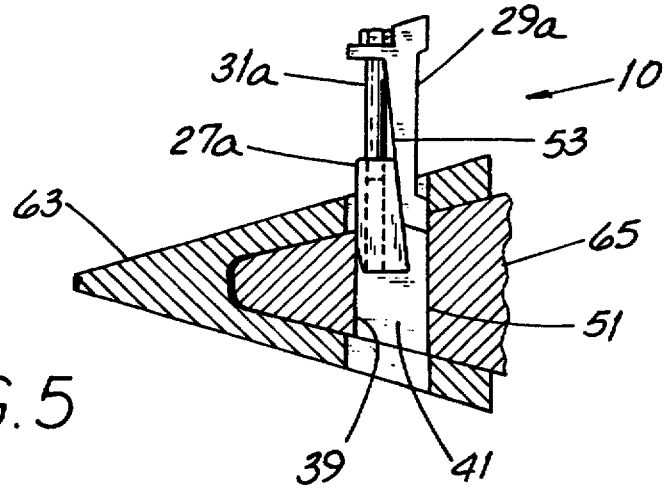
FIG. 5 is a side elevation view of the first embodiment of the invention shown in an initial insertion position in a tooth assembly. Parts are shown in cross-section, other parts are broken away and hidden surfaces of parts are shown in dashed outline.
Figure 6:
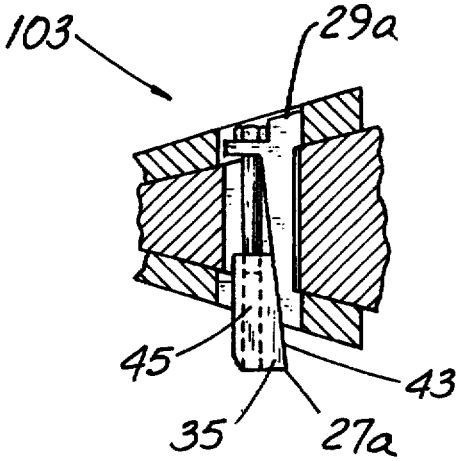
FIG. 6 is a side elevation view like FIG. 5 and showing the invention in an intermediate position in a tooth assembly. Parts are shown in cross-section, other parts are broken away and hidden surfaces of parts are shown in dashed outline.
Figure 7:
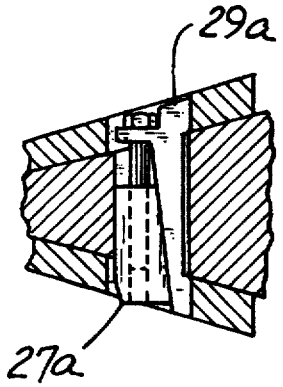
FIG. 7 is a side elevation view like FIG. 5 and showing the invention in the final tip-retaining position in a tooth assembly. Parts are shown in cross-section, other parts are broken away and hidden surfaces of parts are shown in dashed outline.

In one highly-preferred variant of the method involving the first embodiment of FIGS. 5–6 (which generally show an assembly sequence), the wedge-like members 27a, 29a are inserted into the aperture 41 substantially simultaneously. The first wedge-like member 27a is threaded to a tension member 31a extending through the plate 67 and the drawing step includes turning the adjustment device 33a to decrease the distance between the first member 27a and the plate 67.

In another highly-preferred variant of the method involving the second embodiment of FIGS. 9–10 (which also generally shown an assembly sequence), the first wedge-like member 27b and the second wedge-like member 29b are inserted into the aperture 41 in sequence. The first wedge-like member 27b has a tension member 31b coupled thereto by a pivot joint, the second member 29b has a notch 91 and the drawing step includes pivoting the member 31b into the notch 91 and tensioning the member 31b by tightening the device 33b.

In the instance of the second embodiment of the assembly 10 (shown in FIGS. 8–11), insertion of the first wedge-like member 27b is by threading an installation tool 105 onto the upper exposed end of the member 31b and lowering the tool 105 and the member 27b down through the aperture 41 to extend somewhat below the aperture 41 as shown in FIGS. 9 and 10. After so doing, there is ample clearance to lower the second wedging member 29b into the aperture 41 and position it as shown in FIG. 10.

The tension member 31b is then pivotably tipped into the receiving notch 91 and the installation tool 105 is removed. A conventional tool, e.g., a socket wrench, is then used to tighten the adjustment device 33b while retaining the washer 97 in contact with the floor 101 of the pocket 93. As the device 33b is tightened, the first wedging member 27b is drawn into wedged relationship with the second wedging member 29b and the tooth tip 63 is firmly retained on the base 65.

Several highly desirable advantages are apparent from the foregoing. One is that the retention assembly 10 can be installed and removed through the open spatial region 103 above the tooth assembly 23. There is no need to overturn the bucket 21 or to work under a propped-up bucket 21. And such installation and removal is without resorting to drive pins 171, removing such pins 171 with drift pins and the like. Another advantage is that the tooth tip 63 is retained on the base 65 by means other than friction alone. While friction is helpful in retention, there is also a bolt-like tension member 31 retaining the wedging members 27, 29 in a tightly-fitted position. That is, some wear can (and will) occur but because member 31 is in tension and therefore stretched slightly, such wear will not cause the assembly 10 to immediately become loose.

And that is not all. In the first embodiment of the assembly 10 shown in FIGS. 4–7, the tension member 31a can be loosened and then struck from the top to "de-wedge" the first member 27a from the second member 29a. In the second embodiment of the assembly 10 shown in FIGS. 8–12, 14, the tension member 31b can be loosened and the upper end of member 27b then struck to accomplish the same purpose. However, there is yet another way to configure the first member 27b so that the second embodiment of the assembly 10 can be easily de-wedged.

Referring to FIGS. 15A and 15B, the member 27b includes a pivot pocket 107 and a hollow "arm" 109 vertically adjacent to and at 90° to the pocket 107. The pocket 107 is similar in function to pocket 81 shown in FIG. 8 in that the T-shaped pivot head 83 is positioned in pocket 107 when the assembly 10 is installed.

However, pocket 107 is unlike pocket 81 in that pocket 107 is not directly open to the bottom of the member 27b. Rather, pocket 107 has a "floor" 113 and when the adjustment device 33b is loosened and pivot head 83 lowered to contact the floor 113, the user can then tap the upper end of the tension member 31b to drive the member 27b downward and de-wedge the assembly 10.

However, arm 109 (which is at 90° to pocket 107) is open to the bottom of the member 27b so that the member 31b can be installed and removed. More particularly, member 31b is installed by inserting it upward through arm 109 (with the pivot head 83 in registry with arm 109) until the pivot head 83 is above the floor 113. The member 31b is then rotated 90° until the pivot head 83 is in registry with pocket 107 (and therefore at a 90° angle to the arm 109) and the head 83 is thereupon seated in the pocket 107.

While the invention has been described in connection with a few embodiments, it is to be clearly appreciated that such embodiments are by way of example and not by way of limitation.

We claim:

1. In a digging tooth assembly having first and second wedged members retaining a digging tooth tip on a tooth base, the tooth tip having an underside, the improvement comprising:

a tension member coupled to the first member and engaging the second member;

the second member has a pair of protrusions straddling the base and bearing against a respective pair of surfaces of the tooth tip for retaining such second member at a position with respect to such base and for urging the tip against the base;

the tension member has an adjustable effective length, and wherein:

the tip is a sleeve-type tip;

the wedged members are retained in a hole extending downward from the top of the tip;

the wedged members are drawn into wedged engagement with one another by the tension member;

the hole has a top end; and the wedged members are configured to be withdrawn through such top end without having access to the underside of the tooth tip.

2. The assembly of claim 1 wherein:

the tooth base includes an aperture having a forward face;

the second member includes an angled face having an upper portion and a lower portion; and, the upper portion is closer to the forward face than the lower portion.

3. The assembly of claim 2 wherein:

the bolt and the first member are coupled to one another by a pivot joint;

the angled face has a notch; and, the bolt is mounted for pivoting movement into and out of the notch.

4. The assembly of claim 3 wherein:

the bolt has a long axis and extends through a plate in overlapping engagement with the second member;

the plate comprises a self-aligning washer compensating for changes in angularity between the bolt long axis and the angled face.

5. The assembly of claim 2 wherein the first member has an angled face in sliding engagement with the angled face of the second member and the angled faces are conformable serrated, thereby increasing the frictional surface areas of the faces.

6. The assembly of claim 1 wherein:

the tension member includes a bolt coupled to the first member and extending through an opening in a plate in overlapping engagement with the second member; and the opening is slotted, thereby permitting relative tipping movement of the bolt with respect to the first member.

7. The assembly of claim 6 wherein the bolt and the first member are coupled to one another by a spherical pivot joint, thereby permitting the bolt to move in more than one plane.

8. The assembly of claim 1 including an open spatial region above the assembly and wherein:

the tension member includes an adjustment device accessible through the region; and, the adjustment device is rotatable for changing the effective length of the tension member, thereby wedging and de-wedging the members.

9. In a method for assembling a digging tooth assembly having (a) an aperture extending downward from the top of the tip assembly, (b) an open spatial region above the aperture and (c) a tooth base supporting a sleeve-type tooth tip and wherein the tip and the base define the aperture, the method improvement comprising the steps of:

attaching a bolt to a first wedge-like member;

inserting the first wedge-like member downward through the spatial region into the aperture to a position extending somewhat below the aperture;

thereafter inserting a second wedge-like member downward through the spatial region into the aperture;

moving the first wedge-like member upward into the aperture;

coupling the bolt to the second wedge-like member; and, drawing the members to wedged engagement with one another.

10. The method of claim 9 wherein:

the bolt is attached to the first wedge-like member by a pivot joint;

the second member has a notch; and the drawing step includes:

pivoting the bolt into the notch; and tensioning the bolt.

11. The method of claim 9 further having steps for de-wedging the first member and the second member for disassembly, such steps including:

loosening the bolt; and, striking the bolt to de-wedge the members.

12. The method of claim 9 wherein:

the first wedge-like member has a bolt coupled thereto and the bolt has an exposed end; and, insertion of the first wedge-like member is by threading an installation tool onto the exposed end of the bolt and lowering the tool and the bolt into the aperture.

13. In a method for assembling a digging tooth assembly having (a) an open spatial region above the assembly and (b) a tooth base supporting a tooth tip and wherein the tip and the base define an aperture, the method improvement comprising the steps of:

inserting a first wedge-like member through the spatial region into the aperture;

subsequently inserting a second wedge-like member through the spatial region into the aperture; and, drawing the first member toward the spatial region to wedged engagement with the second member, and wherein the first wedge-like member has a bolt coupled thereto by a pivot joint, the second member has a notch and the drawing step includes:

pivoting the bolt into the notch; and, tensioning the bolt.

14. In a digging tooth assembly having first and second wedged members retaining a digging tooth tip on a tooth base, the improvement comprising:

a tension member coupled to the first member and engaging the second member;

the tension member and the first member are coupled to one another by a pivot joint;

the tension member has an adjustable effective length, and wherein:

the tip is a sleeve-type tip;

the tooth base includes an aperture having a forward face;

the second member includes an angled face having an upper portion and a lower portion;

the upper portion is closer to the forward face than the lower portion;

the angled face has a notch;

the wedged members are retained in a hole extending downward from the top of the tip;

the tension member is mounted for pivoting movement into and out of the notch; and the wedged members are drawn into wedged engagement with one another by the tension member.

15. In a method for assembling a digging tooth assembly having (a) an aperture extending downward from the top of the tip assembly, (b) an open spatial region above the aperture and (c) a tooth base supporting a sleeve-type tooth tip and wherein the tip and the base define the aperture, the method improvement comprising the steps of:

inserting a first wedge-like member downward through the spatial region into the aperture, the first wedge-like member having a bolt coupled thereto by a pivot joint;

thereafter inserting a second wedge-like member downward through the spatial region into the aperture, the second wedge-like member having a notch;

pivoting the bolt into the notch; and drawing the members to wedged engagement with one another by tensioning the bolt.

16. In a digging tooth assembly having first and second wedged members retaining a digging tooth tip on a tooth base, the improvement comprising:

a bolt coupled to the first member and engaging the second member, the bolt having an adjustable effective length and being coupled to the first member by a pivot joint;

and wherein:

the tooth base includes an aperture having a forward face;

the second member includes an angled face having an upper portion, a lower portion and a notch;

the upper portion is closer to the forward face than the lower portion;

the first member has an angled face in sliding engagement with the angled face of the second member;

the angled faces are conformable serrated; and the bolt is mounted for pivoting movement into and out of the notch.

17. The assembly of claim 16 wherein:

the bolt has a long axis and extends through a plate in overlapping engagement with the second member;

the plate comprises a self-aligning washer compensating for changes in angularity between the bolt long axis and the angled face.

* * * * *